United States Patent [19]

Lee

[11] Patent Number: 4,743,712

[45] Date of Patent: May 10, 1988

[54] SIGNAL CABLE ASSEMBLY WITH FIBROUS INSULATION AND AN INTERNAL CORE

[76] Inventor: Noel Lee, 47 W. Park Dr., Daly City, Calif. 94015

[21] Appl. No.: 32,331

[22] Filed: Mar. 30, 1987

[51] Int. Cl.[4] ..... H01B 11/00

[52] U.S. Cl. ..... 174/113 C; 174/128 R; 174/130; 174/131 A

[58] Field of Search ..... 174/113 C, 131 A, 115, 174/128 R, 130

[56] References Cited

U.S. PATENT DOCUMENTS

| | | | |
|---|---|---|---|
| 1,211,153 | 1/1917 | Hochstadter | 174/115 |
| 1,691,869 | 11/1928 | Fowle | 174/128 R |
| 1,727,971 | 9/1929 | Ford | 174/112 |
| 2,043,401 | 6/1936 | Wells | 174/113 C |
| 2,509,894 | 5/1950 | Toulmin, Jr. et al. | 174/128 R |
| 2,978,530 | 4/1961 | Braeckman | 174/34 |
| 3,261,907 | 7/1966 | Morrison | 174/115 |
| 3,355,544 | 11/1967 | Costley et al. | 174/106 R |
| 3,584,139 | 6/1971 | Swanson | 174/115 X |
| 3,602,632 | 8/1971 | Ollis | 174/36 |
| 3,678,177 | 7/1972 | Lawrenson | 174/113 C |
| 3,758,704 | 9/1973 | Naud | 174/113 X |
| 3,772,454 | 11/1973 | Donecker et al. | 174/115 X |
| 3,815,054 | 6/1974 | McClure et al. | 174/115 X |
| 4,006,289 | 2/1977 | Roe et al. | 174/131 A X |
| 4,110,554 | 8/1978 | Moore et al. | 174/115 X |
| 4,131,757 | 12/1978 | Felkel | 174/107 |
| 4,158,185 | 6/1979 | Dageforde et al. | 174/113 R X |
| 4,250,351 | 2/1981 | Bridges | 174/106 R |
| 4,358,636 | 11/1982 | Ijff et al. | 174/115 X |
| 4,538,023 | 8/1985 | Brisson | 174/115 |
| 4,677,256 | 6/1987 | Bauer et al. | 174/113 C X |

FOREIGN PATENT DOCUMENTS

| | | | |
|---|---|---|---|
| 2900302 | 7/1980 | Fed. Rep. of Germany | 174/115 |
| 572618 | 11/1923 | France . | |
| 2049262 | 12/1980 | United Kingdom . | |

*Primary Examiner*—Morris H. Nimmo
*Attorney, Agent, or Firm*—Warren B. Kice

[57] ABSTRACT

A cable in which a core is surrounded by a plurality of bundles of wire conductors. Each bundle is formed by a plurality of wire strands twisted around a central conductor which is wrapped by a strand of dielectric material.

4 Claims, 1 Drawing Sheet

FIG. 1
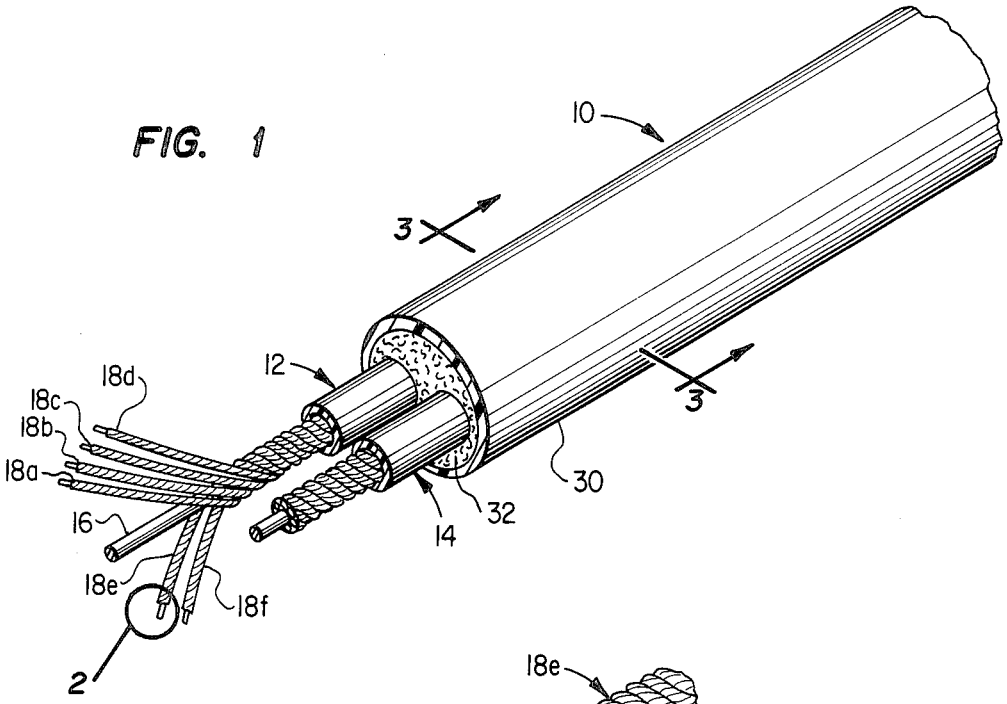
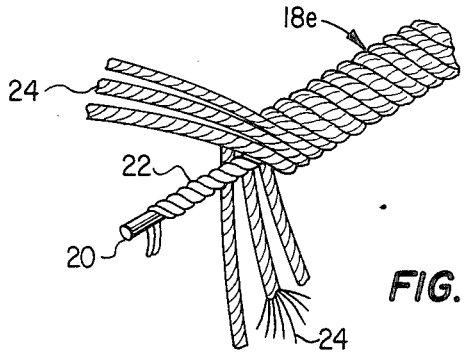
FIG. 2
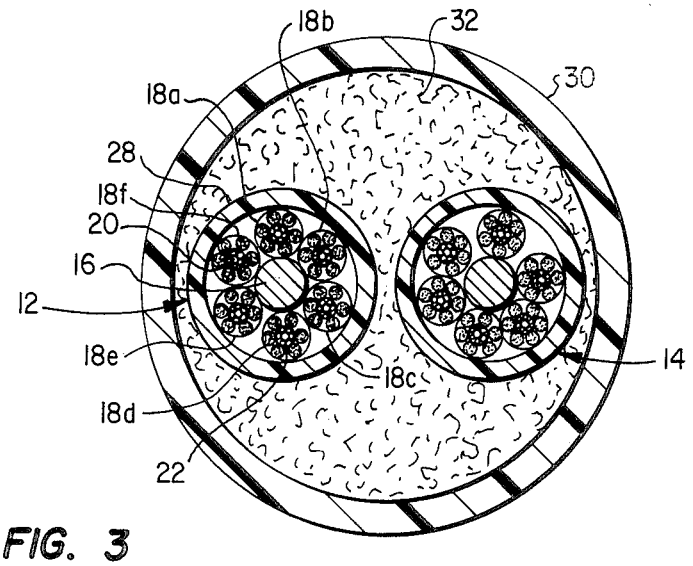
FIG. 3

SIGNAL CABLE ASSEMBLY WITH FIBROUS INSULATION AND AN INTERNAL CORE

BACKGROUND OF THE INVENTION

This invention relates to a signal cable assembly and, more particularly, to a cable assembly for transmitting an electrical signal between a power source and a load.

Various types of cables have been used to transfer electrical current between a power source and load. For example, the signal from an audio amplifier is transmitted by a cable to a loudspeaker for reproduction. Standard cables of this type are usually formed by a plurality of twisted wire strands surrounded by a sleeve of insulating dielectric material of rubber or plastic. However, this type of insulation causes problems in the reprodued signal for what is believed to be the following reasons.

First of all, the current flowing through a conductor creates a magnetic field extending radially outwardly from the center of the conductor. The magnetic flux within the field is a component of the signal transmitted through the cable, and is momentarily stored by the standard dielectric insulating material and released immediately thereafter. This released energy is, of course, delayed with respect to the main signal passing through the cable which causes aberrations in the signal and a "noise floor".

Secondly, at least a portion of this magnetic flux energy passing through, or briefly stored by, the dielectric is converted to heat and is thus lost which, in the case of an audio cable, caused a reduction in amplitude of the bass frequencies that are reproduced, and a reduction in the reproduction of the leading edge of the musical transients which also contributes to the loss of clarity in the reproduced audio signal.

SUMMARY OF THE INVENTION

It is therefore an object of the present invention to provide a cable assembly which minimizes distortion caused by changing electromagnetic fields as the audio signal travels through the cable.

It is a further object of the present invention to provide a cable assembly of the above type in which energy losses in the signal as it travels through the cable assembly are minimized.

It is a still further object of the present invention to provide a cable assembly utilizing a plurality of wire conductors having different gauges for transmitting different frequency bands of the signal.

It is a still further object of the present invention to provide a cable assembly of the above type in which a strand of fibrous insulating material is wrapped around a conductor to minimize the effect of the electromagnetic fields on the signal.

It is a still further object of the present invention to provide a signal cable of the above type in which the conductors surround a center dielectric member.

Toward the fulfillment of these and other objects, the cable assembly of the present invention comprises a plurality of bundles of wire conductors surrounding a dielectric member. Each bundle includes a central conductor having a fibrous strand of dielectric material wrapped therearound, and a plurality of wire strands surrounding the central conductor.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawing wherein:

FIG. 1 is a partial perspective view depicting a signal cable assembly of the present invention, with portions of the components of the assembly being cut short and shown unwound for convenience of presentation;

FIG. 2 is an enlarged view of the circled portion of FIG. 1 with a portion of the conductors being unwound for convenience of presentation; and FIG. 3 is an enlarged cross-sectional view taken along the line 3—3 of FIG. 1.

DESCRIPTION OF THE PREFERRED EMBODIMENT

Referring specifically to the drawings, the reference numeral 10 refers, in general, to the signal cable assembly of the present invention which comprises a first cable 12 extending in a juxtaposed, parallel relationship to a second cable 14.

The cable 12 is formed by a central, solid, rod-like dielectric core 16 surrounded by six bundles 18*a*–18*f* of wire conductors. The bundles 18*a*–18*f* are wrapped about the core 16, and as shown in FIGS. 2 and 3, each bundle is formed by a central conductor 20 having a string, or strand, 22 of a fibrous dielectric material wrapped therearound, and a plurality of wire strands 24 wrapped around the wrapped central conductor. The bundles 18*a*–18*f*, the strands 22 and the wire strands 24 are wrapped in the same direction, i.e., in a counterclockwise direction as viewed in FIGS. 1 and 2. The diameter of each central conductor 20 is greater than that of each of the strands 24 in each bundle.

The core 16 is fabricated from a dielectric material, such as polypropylene, and the wire strands 24 are of a current carrying material, such as copper. The strand 22 is fabricated from a staple or filament fiber of acetate, aramid, carbon, graphite, cermaic, cotton glass, plastic, silica, quartz or vinyl material and can be spun into spun yarns or filament yarns in accordance with conventional techniques. The strand 22 is thus relatively low in density and relatively permeable which enables it to capture air in its interstices and thus improve its dielectric properties. As a result, two fairly closely matched insulative materials (fibre and air) operate integrally with minimal insulation characteristic differences and thus provide superior insulative performance.

The cable 12 also includes a sleeve 28 of insulating material, such as rubber or plastic, which extends around the assembly formed by the core 16 and the bundles 18*a*–18*f*. Since the cable 14 is identical to the cable 12 it will not be described in any detail.

Both of the cables 12 and 14 are surrounded by an outer insulating sleeve 30 of a dielectric flexible material, such as plastic or rubber, and a dielectric material 32 extends around the cables and within the sleeve.

With the exception of the core 16, all of the components of the cable 12 (and cable 14) have been depicted with their lengths cut short for the convenience of presentation, it being understood that in a normal assembly, all of their ends would extend flush with the end of the core 16.

One of the cables 12 or 14 can carry the positive signal and the other can carry the negative signal, with the respective uninsulated ends of each cable being connected, via conventional connectors, such as spade lugs, banana plugs, or the like, to the positive and negative terminals of a power source and a load, it being understood that, since the dielectric cores 16 are non-conductive they are not connected to the power source or load.

As an alternative embodiment, in order to reduce costs each dielectric core 16 can be replaced by a wire or conductor surrounded by insulation and non-terminated as discussed above.

Several advantages result from the foregoing. For example, the high dielectric properties of the fibrous dielectric material extending around the various conductors minimizes the storage and immediate release of the ancillary signal carried by the magnetic flux and thus reduces the introduction of a delayed signal and noise floor as described above. Also, when the cable is used to connect audio components, the fibrous dielectric material minimizes the loss of bass energy and reduction in the leading edge of the musical transients.

It is understood that several variations may be made in the foregoing without departing from the scope of the invention. For example, although a dual cable construction is shown which is normally adapted to carry the positive and negative signals, respectively, of an electric signal, it is understood that a single cable is within the scope of the present invention if a proper application exists. Also, one cable assembly can be formed by two sub-assemblies, each consisting of multiple pairs of cables identical to the cables 12 and 14. Further, the dielectric insulation can be wrapped around other conductors in each bundle of conductors.

It is also understood that although the cable assembly of the present invention is especially designed for use in audio and video applications, that the invention is not so limited but is suited for any type of application in which it is desired to transfer an electrical signal between a source and a load with a minimum of aberrations in the signal.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention therein.

What is claimed is:

1. A cable assembly, comprising:

a core, a plurality of bundles of electrical conductors wrapped around said core, each bundle comprising:

a central conductor of a relatively large diameter, a strand of dielectric material wrapped around said central conductor, and a plurality of wire strands each of a relatively small diameter wrapped around said wrapped central conductor; and insulation means extending around said bundles;

said strand of dielectric material, said wire strands and said bundles being wrapped in the same direction.

2. The assembly of claim 1 wherein said core is in the form of an elongated, rod-like, solid dielectric material extending for the entire length of said cable assembly.

3. A cable assembly comprising a pair of cables adapted to respectively carry the positive and negative signals between a power source and a load, each cable comprising:

a core a plurality of bundles of electrical conductors wrapped around said core, each bundle comprising:

a central conductor of a relatively large diameter, a strand of dielectric material wrapped around said central conductor, and a plurality of wire strands each of a relatively small diameter wrapped around said wrapped central conductor; and insulation means extending around said bundles;

said strand of dielectric material, said wire strands and said bundles being wrapped in the same direction.

4. The assembly of claim 3 wherein said core is in the form of an elongated, rod-like, solid dielectric material extending for the entire length of said cable.

* * * * *